US008065900B2

(12) United States Patent
Hidaka et al.

(10) Patent No.: US 8,065,900 B2
(45) Date of Patent: Nov. 29, 2011

(54) METHOD OF MANUFACTURING PLUG USED TO PIERCE AND ROLL METAL MATERIAL, METHOD OF MANUFACTURING METAL PIPE AND PLUG USED TO PIERCE AND ROLL METAL MATERIAL

(75) Inventors: Yasuyoshi Hidaka, Osaka (JP); Naoya Hirase, Osaka (JP); Yasuhiro Kouchi, Osaka (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 150 days.

(21) Appl. No.: 12/533,390

(22) Filed: Jul. 31, 2009

(65) Prior Publication Data

US 2010/0018281 A1 Jan. 28, 2010

Related U.S. Application Data

(63) Continuation of application No. PCT/JP2008/051766, filed on Feb. 4, 2008.

(30) Foreign Application Priority Data

Feb. 5, 2007 (JP) ..... 2007-025985
Jan. 31, 2008 (JP) ..... 2008-020129

(51) Int. Cl.
*B21B 19/04* (2006.01)

(52) U.S. Cl. ..... 72/97; 72/342.2; 72/364

(58) Field of Classification Search ..... 72/38, 46, 72/47, 97, 208, 209, 53, 69, 342.1, 342.2, 72/342.5, 364
See application file for complete search history.

(56) References Cited

U.S. PATENT DOCUMENTS 4,034,588 A * 7/1977 Way et al. ..... 72/209
4,348,241 A * 9/1982 Kunioka et al. ..... 428/472.2
4,393,677 A * 7/1983 Tamura et al. ..... 72/97
4,451,496 A * 5/1984 Gedwill et al. ..... 427/456
6,210,806 B1 * 4/2001 Hidaka et al. ..... 428/469
7,803,237 B2 * 9/2010 Cokain et al. ..... 148/428

FOREIGN PATENT DOCUMENTS

JP 60-86262 5/1985

(Continued)

OTHER PUBLICATIONS

International Search Report in corresponding PCT/JP2008/051766 dated Mar. 11, 2008.
International Preliminary Report in corresponding PCT/JP2008/051766 dated Aug. 11, 2009

(Continued)

*Primary Examiner* — Edward Tolan
(74) *Attorney, Agent, or Firm* — Marshall, Gerstein & Borun LLP

(57) ABSTRACT

A plug material having a prescribed shape is prepared, the prepared plug material is thermally treated in a heat treatment atmosphere that contains at least 1.0 vol. % oxygen at a heat treatment temperature of at least 950° C. and less than 1050° C. and thus a plug having an oxide scale layer 30 on the surface is manufactured. According to the manufacturing method, pores PO that extend along the surface SF of the plug material are formed under outer scale layer 20 in the oxide scale layer 30, which allows cracks to be more easily propagated in the outer scale layer 20. Therefore, the outer scale layer 20 is more easily peeled off than the conventional one.

10 Claims, 5 Drawing Sheets

FOREIGN PATENT DOCUMENTS

| | | | |
|---|---|---|---|
| JP | 4-270003 | * | 9/1992 |
| JP | 08-206709 | | 8/1996 |
| JP | 8-153559 | * | 1/1998 |
| JP | 10-249412 | * | 9/1998 |
| JP | 10-291008 | | 11/1998 |
| JP | 2002-273505 | | 9/2002 |
| JP | 3777997 | | 9/2002 |

OTHER PUBLICATIONS

Written Opinion (translation) in corresponding PCT/JP2008/051766 dated Aug. 11, 2009.

English Translation of claims in JP-60-86262, filed May 15, 1985, in name of Sumitomo Metal Industries, Ltd.

* cited by examiner

METHOD OF MANUFACTURING PLUG USED TO PIERCE AND ROLL METAL MATERIAL, METHOD OF MANUFACTURING METAL PIPE AND PLUG USED TO PIERCE AND ROLL METAL MATERIAL

TECHNICAL FIELD

The present invention relates to a method of manufacturing a plug, a method of manufacturing a metal pipe, and a plug. The invention more specifically relates to a method of manufacturing a plug used to pierce and roll a metal material, a method of manufacturing a metal pipe using the plug, and the plug.

BACKGROUND ART

The plug for piercing and rolling is used to pierce and roll a heated round billet of a metal material and make it into a metal pipe (seamless pipe). The plug is arranged on the pass line of a piercing mill and penetrates through the billet along the central axis of the billet rotated in the circumferential direction by two inclined rolls opposed to each other with the pass line therebetween. At the time, the plug contacts the billet and receives heat and stress from the billet, and therefore its surface is prone to wear and dissolution.

One approach to prevent the wear and dissolution of the plug surface is to form an oxide scale layer having a thickness of about several hundred micrometers on the plug surface. The oxide scale layer having good wettability and adiabaticity can therefore reduce the wear and dissolution of the plug surface.

The oxide scale layer formed on the plug surface is however sometimes partly peeled off during piercing and rolling. If the oxide scale layer is thus peeled off, the plug ends up having irregularities on the surface. The irregularities are transferred onto the inside surface of a billet in the process of being pierced and rolled. As the result, the metal pipe obtained after the piercing and rolling has defects on its inside surface.

The inventors have proposed a plug used to solve the problem in the disclosure of Japanese Patent No. 3777997. The oxide scale layer formed on the plug surface by thermally treating the plug includes inner scale layer formed on the surface of the plug material and outer scale layer formed on the inner scale layer. The inner scale layer having a dense structure is less easily peeled off. On the other hand, the outer scale layer having a porous structure is more easily peeled off than the inner scale layer. Therefore, according to the Patent Document, the outer scale layer is removed in advance and the plug having the inner scale layer remaining thereon is used for piercing and rolling. The inner scale layer having a dense structure is less easily peeled off than the outer scale layer, and therefore inside surface defects during piercing and rolling can be reduced, so that the wear and dissolution of the plug can be reduced.

While the outer scale layer is more easily peeled off than the inner scale layer, a high load must be applied on the outer scale layer in order to remove the outer scale layer in advance. For example, as disclosed by the Patent Document, the outer scale layer is provided with high impact force using a hammer or the like. Alternatively, the outer scale layer surface must be provided with rapid thermal stress by rapidly heating the surface of the outer scale layer using a burner. The task of removing the outer scale layer includes a large workload. In order to use the plug disclosed by Patent Document for the manufacture of a metal pipe, the outer scale layer must readily be removed.

Note that another prior art document relevant to the present application is JP 8-206709 A.

DISCLOSURE OF THE INVENTION

It is an object of the invention to provide a method of manufacturing a plug for piercing and rolling that allows outer scale layer to be readily removed with a low load and such a plug for piercing and rolling.

The inventors studied about conditions for heat treatment (hereinafter also referred to as "scale treatment") for forming an oxide scale layer on the surface of a plug. As a result, they have found that the outer scale layer is easily peeled off with a low load and the inner scale layer maintains a structure as dense as or denser than the conventional structure when the oxygen concentration in a heat treatment atmosphere is at least 1.0 vol. % and the heat treatment temperature (holding temperature) is at least 950° C. and less than 1050° C. Now, the findings will be described in detail.

The inventors produced two plug material specimens with the chemical composition given in Table 1 having a length of 200 mm, a width of 100 mm, and a thickness of 50 mm. One of the specimens thus produced was subjected to scale treatment in condition 1 in Table 2, and the other was subjected to scale treatment in condition 2.

TABLE 1

| chemical composition (mass %, the balance consisting of Fe and impurities) | | | | | | |
|---|---|---|---|---|---|---|
| C | Si | Mn | Ni | Cr | Mo | W |
| 0.15 | 0.50 | 0.50 | 1.0 | 0.5 | 1.4 | 3.5 |

TABLE 2

| | thermal treatment atmosphere (vol. %, the balance consisting of $N_2$ and impurities) | | | thermal treatment temperature |
|---|---|---|---|---|
| | $O_2$ | $CO_2$ | $H_2O$ | (° C.) |
| condition 1 | 0 | 10 | 10 | 1050 |
| condition 2 | 2.0 | 10 | 10 | 1000 |

With reference to Table 2, the oxygen concentration in the heat treatment atmosphere was set to 0 vol. %, which was the same as that of the conventional case. The heat treatment temperature was set to 1050° C. On the other hand, in condition 2, the oxygen concentration was set to 2.0 vol. %, which was higher than the conventional case. The heat treatment temperature was set to 1000° C., which was lower than that in condition 1. After the heat treatment, a section of an oxide scale layer each formed on the specimens was observed using an optical microscope.

FIG. 1 is a photograph of the section of the specimen of the plug material thermally treated in condition 1 (hereinafter referred to as "conventional plug") and FIG. 2 is a photograph of the section of the specimen of the plug material thermally treated in condition 2 (hereinafter referred to as "inventive plug"). Inner scale layers 10 and 11, and outer scale layers 20 and 21 in the photographs of the sections were identified by an EDX (Energy Dispersive X-ray) micro-analyzer. More specifically, layers consisting of Fe, O (oxygen) and impurities were identified as outer scale layers 20 and 21. Layers consisting of Fe, O (oxygen), and at least one of the alloy elements contained in the base material (plug material specimen) 100 other than Fe were identified as the inner scale layers 10 and 11.

With reference to FIGS. 1 and 2, the outer scale layer and the inner scale layer were also formed on the surfaces of the base materials 100 of the conventional plug and the inventive plug. However, the outer scale layer 20 of the inventive plug had a pore PO in the lower part that extends along the surface SF of the base material. Therefore, the outer scale layer 20 of the inventive plug was easily peeled off with a low load. On the other hand, the outer scale layer 21 of the conventional plug had a denser structure than that of the outer scale layer 20 of the inventive plug, and there was no pore PO that extends along the base material surface SF unlike that observed in the outer scale layer 20 of the inventive plug. Consequently, it was harder to peel off the outer scale layer 21 of the conventional plug than that of the inventive plug.

The inner scale layers 10 and 11 at the conventional plug and the inventive plug both had a dense structure and they were not easily peeled off.

From the foregoing, the inventors concluded that the oxygen concentration of the heat treatment atmosphere and the heat treatment temperature were related to the peelability of the outer scale layer. The inventors then carried out scale treatment in various conditions for oxygen concentrations and heat treatment temperatures and evaluated the peelability of the outer scale layer. It was found as the result that when the oxygen concentration was set to at least 1.0 vol. % and the heat treatment temperature was set to at least 950° C. and less than 1050° C., the inner scale layer had a structure as dense as or denser than the conventional one and was less easily peeled off while the outer scale layer was more easily peeled off with a lower load than the conventional one.

The inventor made the following invention based on the foregoing findings.

A method of manufacturing a plug used to pierce and roll a metal material according to the invention includes the steps of preparing a plug material, and manufacturing a plug including an oxide scale layer having inner scale layer formed on the surface of the plug material and outer scale layer formed on the inner scale layer by thermally treating the prepared plug in a heat treatment atmosphere that contains at least 1.0 vol. % oxygen at a heat treatment temperature of at least 950° C. and less than 1050° C. Here, the outer scale layer is a layer consisting of Fe, O (oxygen) and impurities. The inner scale layer is a layer consisting of Fe, O (oxygen), at least one of the alloy elements included in the plug material other than Fe, and impurities.

When a plug material is thermally treated in the heat treatment condition according to the invention, the outer scale layer in the oxide scale layer formed on the surface is more easily peeled off than the conventional one. On the other hand, the inner scale layer has a structure as dense as or denser than the conventional one. Therefore, only the outer scale layer can easily be peeled off.

Preferably, in the step of manufacturing the plug including the oxide scale layer, the plug is thermally treated in a heat treatment atmosphere that contains at least 2.0 vol. % oxygen.

In this way, the outer scale layer can be peeled off more easily.

Preferably, in the step of manufacturing the plug including the oxide scale layer, the plug is thermally treated at a heat treatment temperature from 950° C. to 1000° C.

In this way, the grain size of the inner scale layer is significantly reduced, so that the adhesion of the inner scale layer to the plug surface is improved.

Preferably, the method of manufacturing a plug further includes the step of removing the outer scale layer in the oxide scale layer.

A method of manufacturing a metal pipe according to the invention includes the steps of manufacturing a plug including an oxide scale layer having inner scale layer formed on the surface of the plug material and outer scale layer formed on the inner scale layer by the above-described manufacturing method, removing the outer scale layer in the oxide scale layer of the plug, and manufacturing a metal pipe by piercing and rolling a metal material using the plug removed of the outer scale layer.

In this way, the outer scale layer that is easily peeled off is removed in advance before the piercing and rolling, and inside surface defects attributable to the peeling of the outer scale layer can be reduced. Note that the outer scale layer of the plug according to the invention can be peeled off more readily and with a lower load than the conventional one.

A plug used to pierce and roll a metal according to the invention is manufactured by the above-described manufacturing method and includes a base material, and an oxide scale layer. The oxide scale layer includes at least inner scale layer.

A plug according to the invention includes a base material, inner scale layer, and outer scale layer. The inner scale layer is formed on the surface of the base material. The outer scale layer is formed on the inner scale layer and has one or more pores that extend along the surface of the base material in its lower part. In the plug according to the invention, in a section of the outer scale layer having a width of 1000 μm, a virtual line parallel to the base material surface and having a length of 1000 μm is arranged in a position that the length of the part of the arranged virtual line that overlaps the one or more pores in the outer scale layer is at least 500 μm.

In this way, cracks can easily be propagated in the outer scale layer defined above. Consequently, the outer scale layer can be peeled off more easily and with a lower load than the conventional one.

BEST MODE FOR CARRYING OUT THE INVENTION

Figure 1:
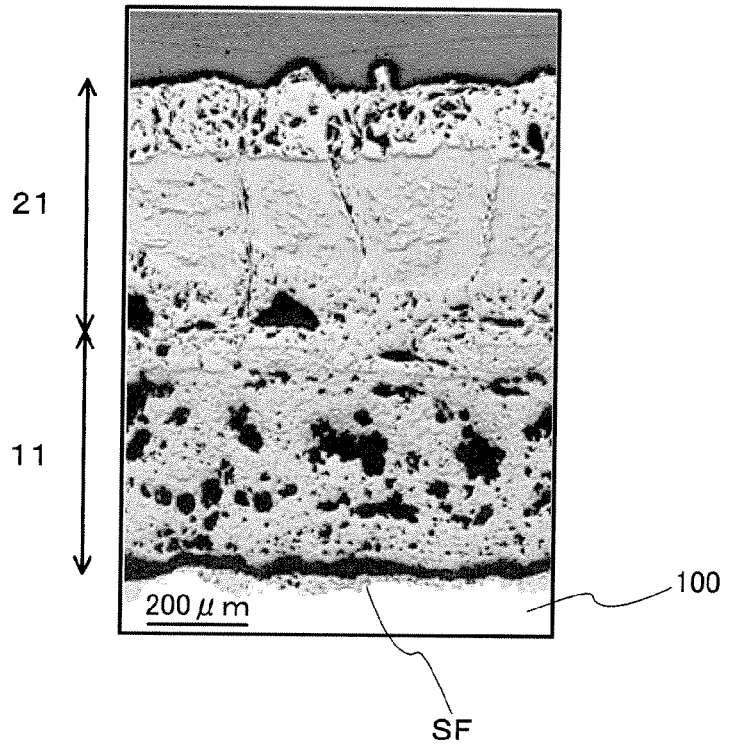
FIG. 1 is a photograph of a section of an oxide scale layer formed on the surface of a plug base material in a thermal treatment condition different from that of the invention.

Now, an embodiment of the present invention will be described in detail with reference to the accompanying drawings, in which the same or corresponding portions are denoted by the same reference characters and their description will not be repeated.

1. Method of Manufacturing Plug

A method of manufacturing a plug for piercing and rolling according to an embodiment of the invention will be described. To start with, a plug material in well-known shape and quality of material and not yet subjected to scale treatment is prepared. The plug material is well known and contains Fe and other alloy elements. The plug material may be for example a tool steel. It may be a Fe—Cr alloy steel, a Fe—C alloy steel or the like.

Then, the prepared plug material is inserted into a heat treatment furnace and subjected to scale treatment so that an oxide scale layer is formed. The scale treatment is carried out in the following heat treatment condition.

(1) Heat Treatment Atmosphere

The oxygen concentration in a heat treatment atmosphere is set to 1.0 vol. % or more. If it is not less than 1.0 vol. %, resulting outer scale layer contains one or more pores that extend along the surface of the base material (plug material), and therefore the outer scale layer can easily be peeled off with a low load. When the oxygen concentration is set to less than 1.0 vol. %, the percentage of pores that extend along the surface of the base material in the outer scale layer is reduced, and therefore the outer scale layer is less easily peeled off.

Figure 3:
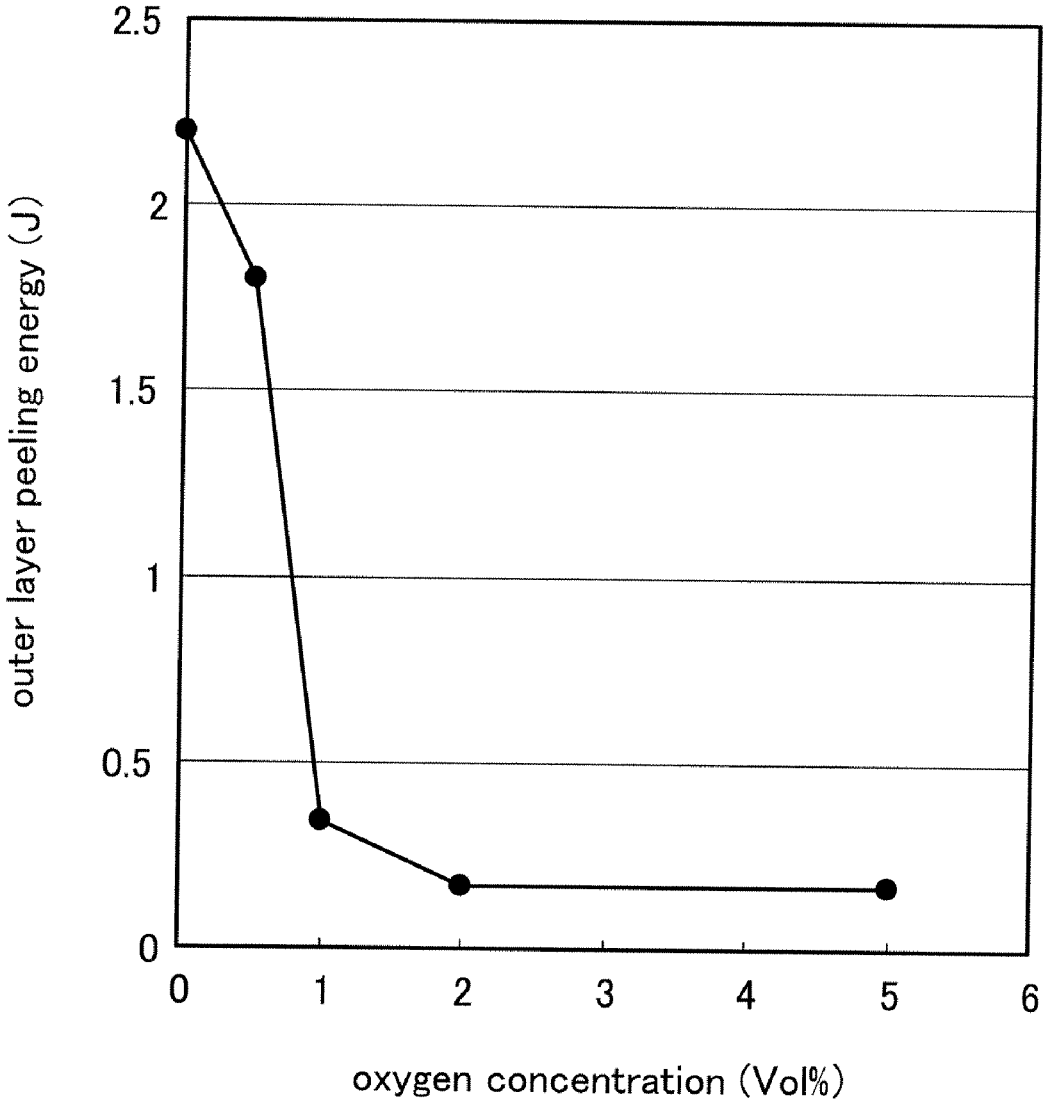
FIG. 3 is a schematic view for use in illustrating a drop ball test.

The oxygen concentration in the heat treatment atmosphere is preferably not less than 2.0 vol. %. FIG. 3 shows the relation between oxygen concentrations in a heat treatment atmosphere and the peelability of outer scale layer. The data in FIG. 3 was obtained by the following method. A plurality of plug material specimens (having a length of 200 mm, a width of 100 mm, and a thickness of 50 mm) having the chemical composition in Table 1 were prepared, and the specimens were subjected to scale treatment in heat treatment atmospheres with different oxygen concentrations. At the time, the heat treatment atmospheres each contained 10 vol. % $Co_2$ and 10 vol. % $H_2O$, and the balance consisting of $N_2$ and impurities. The heat treatment temperature was 1000° C., and the soaking time was 25 hours. After the scale treatment, the peelability of outer scale layers each formed on the surfaces of the specimens was evaluated by a drop ball test.

Figure 4:
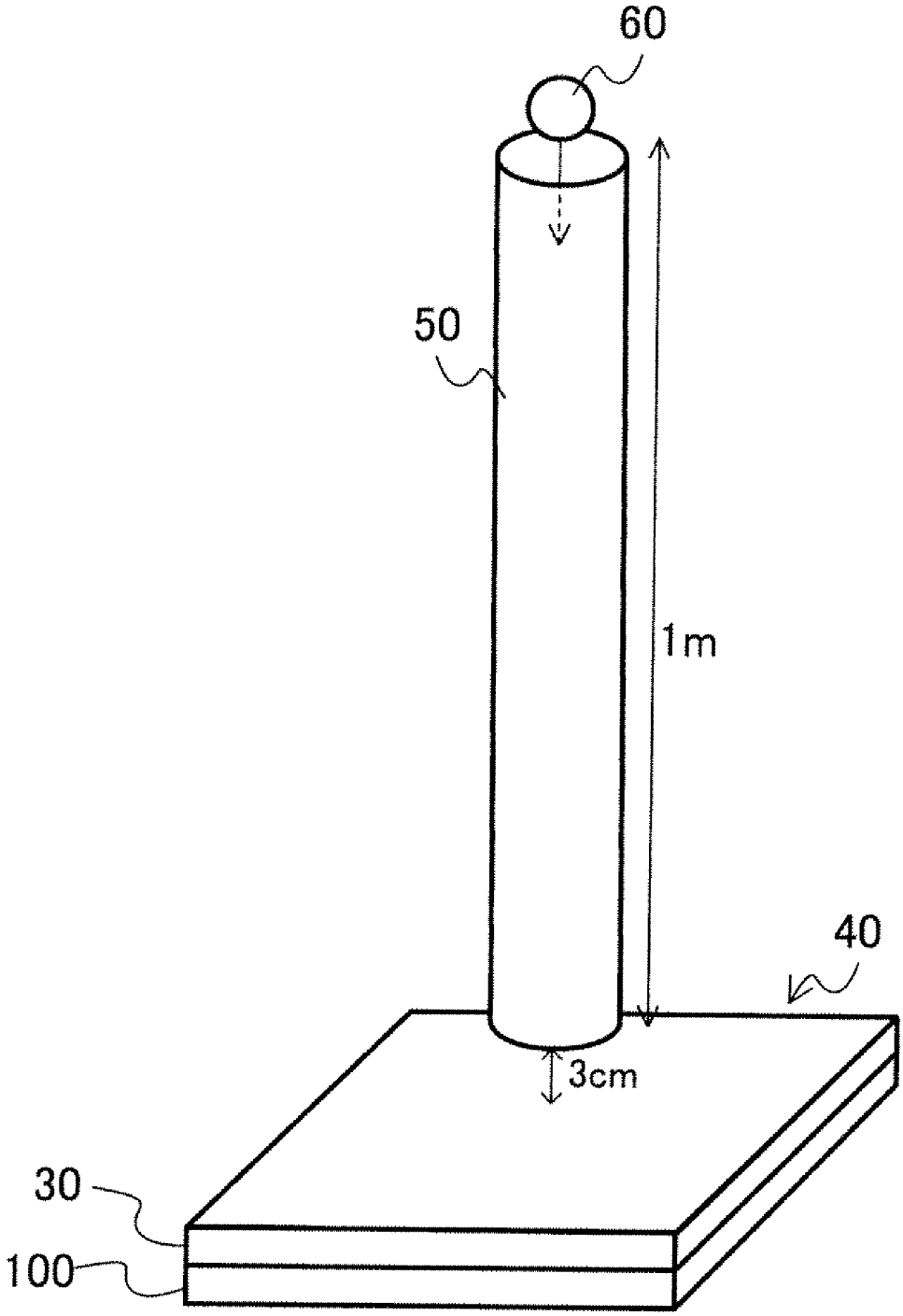
FIG. 4 is a graph showing the relation between oxygen concentrations in a thermal treatment atmosphere and the energy needed to remove outer scale layer formed on the surface of a plug by thermal treatment.

The drop ball test was conducted as follows. As shown in FIG. 4, a metal pipe 50 having an inner diameter of 30 mm, and a length of 1 m was arranged above the outer scale layer of each specimen 40. At the time, the distance between the lower end of the metal pipe 50 and the upper surface of the specimen 40 (i.e., the surface of the outer scale layer) was 3 cm. Stainless steel balls 60 having a diameter of 9.4 mm and a mass of 3.4 g were dropped one by one from the upper end of the metal pipe 50 on the upper surface of the specimen 40 through the metal pipe 50, and it was examined whether the outer scale layer was peeled off every time a ball was dropped. The stainless steel balls 60 continued to be dropped until it was visually confirmed that the outer scale layer was peeled off. The number of the dropped balls was counted until the peeling was confirmed, and the energy necessary for removing the outer scale layer was obtained by the following expression (1) (where the unit is J). Hereinafter the energy will be referred to as "outer layer peeling energy."

$$\text{Outer layer peeling energy } (J) = m \times g \times h \times n \quad (1)$$

where m is the mass (kg) of each of the stainless steel balls, g is the gravitational acceleration ($m/s^2$), h is the height (m) from the outer scale layer surface at which the stainless steel ball was placed before it was dropped, and n is the number of dropped balls until the peeling off of the outer scale layer was confirmed.

With reference to FIG. 3, the outer scale layer peeing energy sharply decreased as the oxygen concentration in the heat treatment atmosphere was raised from 0 vol. %. When the oxygen concentration was 2.0 vol. % or more, the outer scale layer peeling energy no longer decreased. Therefore, the oxygen concentration is more preferably not less than 2.0%.

The upper limit for the oxygen concentration is preferably 20 vol. %, more preferably 10 vol. %.

Note that when the oxygen concentration is set to 1.0 vol. % or more, and the heat treatment temperature is set within the following range, the inner scale layer maintains its dense structure. Therefore, even when the oxygen concentration is not less than 1.0 vol. %, the inner scale layer is less easily peeled off.

The other chemical components than the oxygen in the heat treatment atmosphere are the same as those in a well known heat treatment atmosphere when conventional scale treatment is carried out. For example, the heat treatment atmosphere contains 5 vol. % to 15 vol. % $CO_2$ and 5 vol. % to 25 vol. % $H_2O$, and the balance consists of $N_2$ and impurities. Note that about 3 vol. % CO at most may be contained instead of part of $N_2$.

(2) Heat Treatment Temperature

The heat treatment temperature is at least 950° C. and less than 1050° C. If the temperature is 1050° C. or higher, the outer scale layer is less easily peeled off. On the other hand, if the temperature is less than 950° C., a sufficient oxide scale layer is not generated and the heat treatment time must excessively be prolonged in order to increase the thickness of the oxide scale layer. Therefore, the heat treatment temperature is at least 950° C. and less than 1050° C. Note that if the temperature is set within the above-described range, the inner scale layer maintains a dense structure like the conventional one.

The heat treatment temperature is preferably from 950° C. to 1000° C. When the heat treatment temperature is from 950° C. to 1000° C., the inner scale layer has a denser structure and its adhesion with the plug material surface is improved, which will be now described in detail.

When the heat treatment temperature is set in the range from 950° C. to 1000° C., the grain size of the inner scale layer can be reduced. When the scale grain size is reduced, the inner scale layer has a dense structure and its adhesion with the plug surface is improved. Now, how the grain size of the inner scale layer is reduced by setting the heat treatment temperature in the range from 950° C. to 1000° C. will be described.

Figure 5:
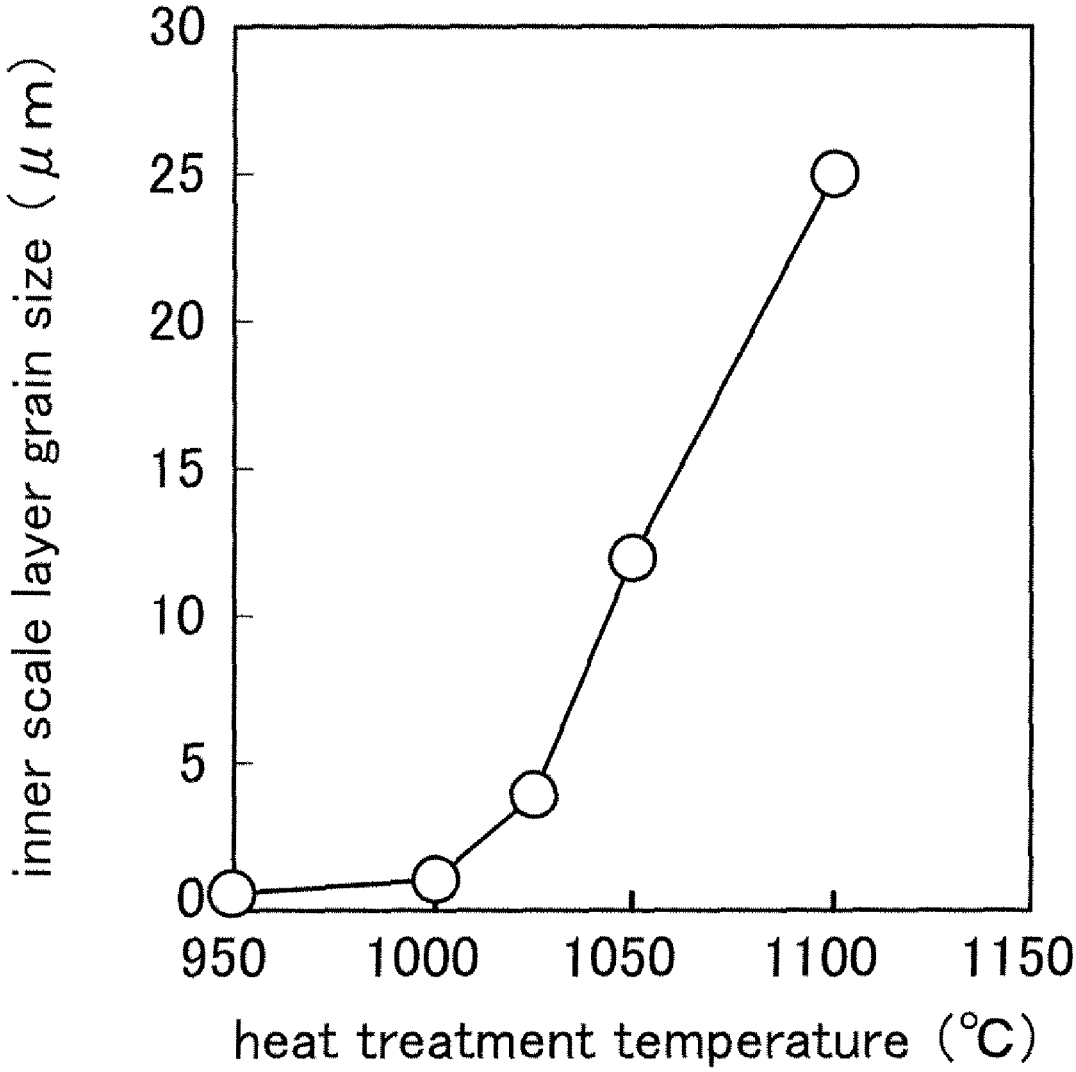
FIG. 5 is a graph showing the relation between thermal treatment temperatures and the scale grain size of inner scale layer formed on the surface of a plug by thermal treatment.

FIG. 5 shows the relation between heat treatment temperatures and the grain size of inner scale layer. The data in FIG. 5 was obtained by the following method. Plug material specimens (having a length of 200 mm, a width of 100 mm, and a thickness of 50 mm) having the chemical composition in Table 1 were prepared and subjected to scale treatment at different heat treatment temperatures. At the time, the heat treatment atmosphere was the same as that in condition 2 (with an oxygen concentration of 2.0 vol. %) in Table 2. The soaking time was 25 hours for all the specimens.

The grain size of the inner scale layer in each of the specimens after the heat treatment was obtained. More specifically, a sectional structure of the inner scale layer was observed using an SEM (scanning electron microscope) and arbitrary scale grains were randomly selected from the observed sectional structures. Then, the grain sizes of the scale grains were obtained. The maximum size of each scale grain was obtained as the grain size of the scale grain. The average of the measured grain sizes of the scale grains was obtained, and the obtained average was determined as the grain size (μm) of the inner scale layer grains of the specimen.

With reference to FIG. 5, the inner scale layer grain size was sharply dropped as the heat treatment temperature was lowered, and the inner scale layer grain size was 1 μm or less at a heat treatment temperature of 1000° C. On the other hand, when the heat treatment temperature was 1000° C. or less, the inner scale layer grain size was not much reduced as the heat treatment temperature was lowered. Therefore, the heat treatment temperature is more preferably from 950° C. to 1000° C.

(3) Other Conditions

The heat treatment time was the same as well known scale treatment carried out to form an oxide scale layer. For example, when the heat treatment time is from 6 hours to 25 hours at the above-described heat treatment temperature, the thickness of the oxide scale layer reaches a preferable thickness from 200 μm to 1000 μm. Note that the heat treatment time may be longer than 25 hours or less than 6 hours.

The cooling rate for the plugs after the heat treatment is preferably 25° C./hr to 150° C./hr. Note that higher cooling rate is more preferable. This is because as the cooling rate increases, cracks are formed in the outer scale layer, which causes the scale to be more easily peeled off. Note that the temperature is preferably from room temperatures to 600° C. at the end of cooling (when the item is taken out from the furnace). The other conditions are the same as those of well-known scale treatment carried out to form an oxide scale layer.

2. Structure of Oxide Scale Layer

The plug produced by the above-described method has an oxide scale layer on its surface. As described above, the thickness of the oxide scale layer is preferably in the range from 200 μm to 1000 μm.

Figure 2:
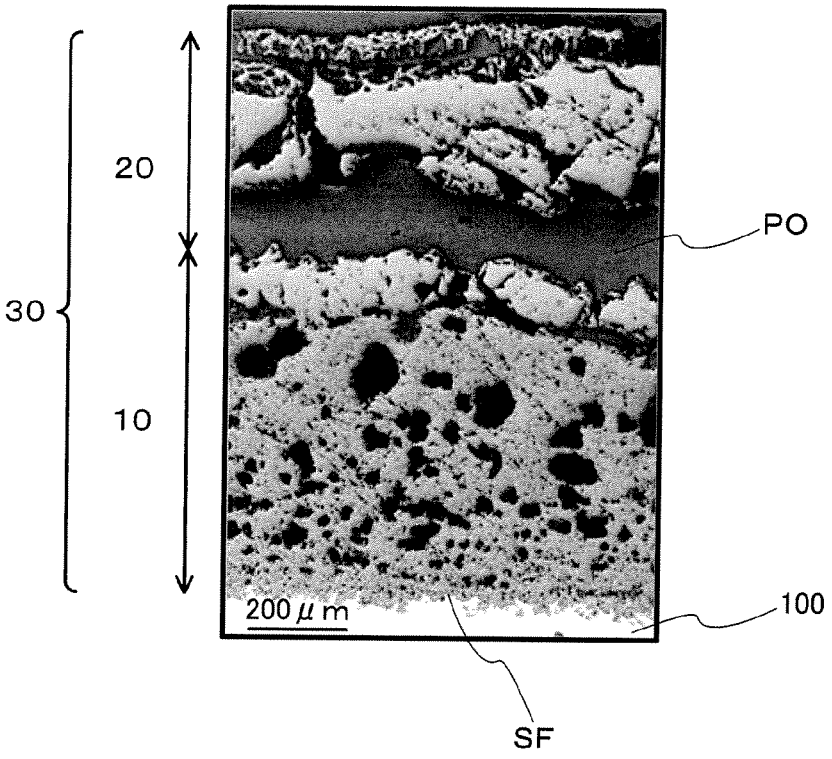
FIG. 2 is a photograph of a section of an oxide scale layer formed on the surface of a plug base material in a thermal treatment condition according to the invention.

With reference to FIG. 2, the oxide scale layer 30 includes inner scale layer 10 formed on the surface SF of the base material (plug material) 100 and outer scale layer 20 formed on the inner scale layer 10. The inner scale layer 10 consists of Fe, O (oxygen), at least one of the alloy elements included in the base material 100 other than Fe, and impurities. The inner scale layer 10 has a dense structure.

On the other hand, the outer scale layer 20 consists of Fe, O (oxygen), and impurities. The outer scale layer 20 further includes a plurality of pores PO that extend along the base material surface SF in its lower part. The pores PO allow cracks to be easily propagated along the base material surface SF, and therefore the outer scale layer is easily peeled off with a low load.

Figure 6:
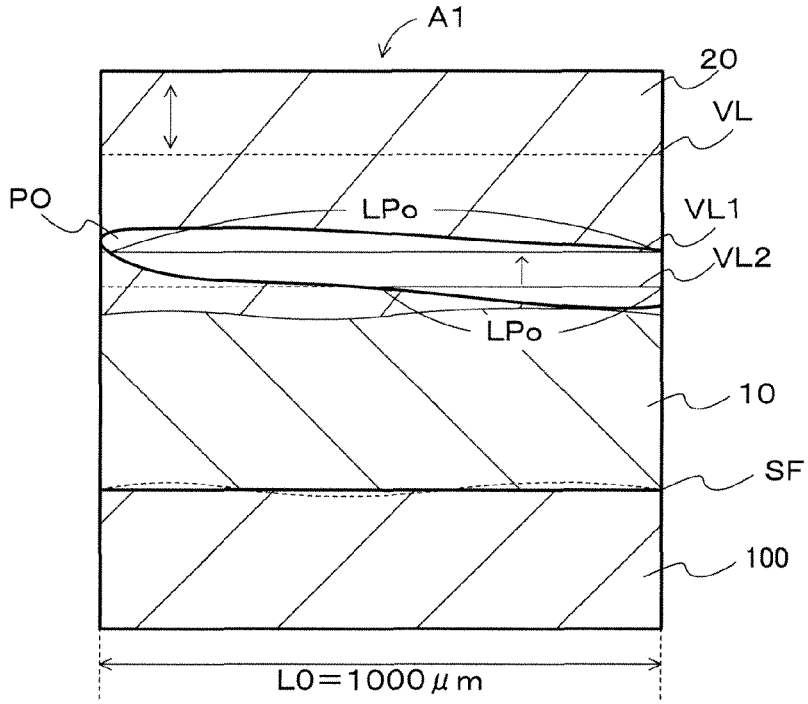
FIG. 6 is a schematic view for use in illustrating a preferable condition for a pore existing in outer scale layer.

One or more pores PO preferably satisfy the following condition. More specifically, FIG. 6 shows a section of an arbitrary region A1 having a width LO of 1000 μm in the vicinity of the surface of the plug. In the section of the region A1, a virtual line VL parallel to the base material surface SF and having a length of 1000 μm is moved in the thickness-wise direction of the outer scale layer (in the vertical direction in the figure). Then, there is a part LPo in which the virtual line VL and a pore PO overlap. In this way, when the virtual line VL is moved in the vertical direction, the maximum value LPmax for the overlapping part LPo of the pore PO and the virtual line VL is preferably not less than 500 μm. In FIG. 6, the part LPo of the virtual line VL1, not of the virtual line VL2, has the maximum length. Stated differently, in the plug according to the invention, the virtual line VL is arranged in such a position that the maximum value LPmax is 500 μm or more.

Figure 7:
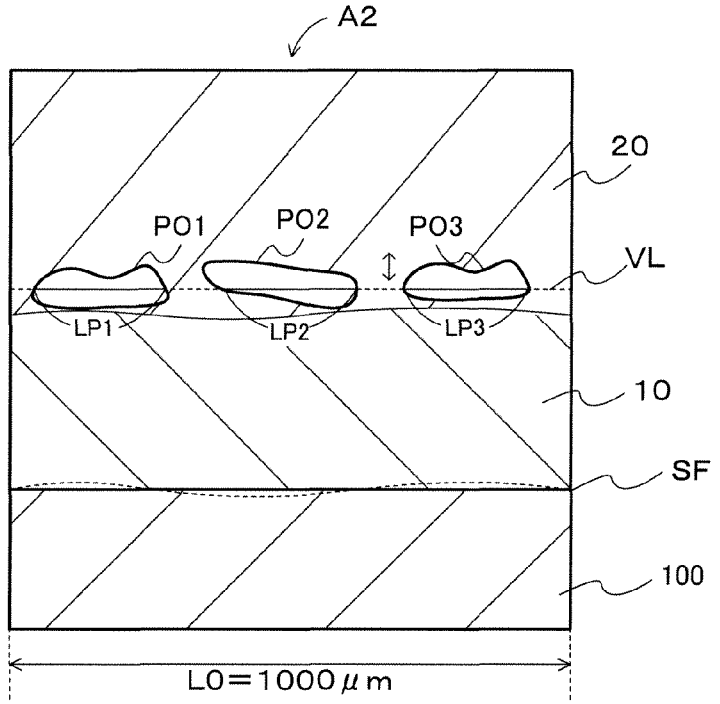
FIG. 7 is another schematic view for use in illustrating a preferable condition for pores existing in outer scale layer, which is different from that in FIG. 6.

As shown in FIG. 7, in a section of the outer scale layer 20 in an arbitrary region A2 having a width LO of 1000 μm, when a plurality of pores PO1 to PO3 extend along the base material surface SF, LPo is the total length of the parts LP1 to LP3 of the pores PO1 to PO3 that overlap the virtual line VL (LP1+LP2+LP3).

Now, the base material surface SF and the virtual line VL are determined as follows. The base material surface in the regional section having a width of 1000 μm selected as described above was plotted at prescribed intervals (on the basis of 10 μm for example). A straight line obtained by a linear function according to a least squares method based on the plotted points is set as the base material surface SF. A straight line parallel to the obtained base material surface SF is defined as the virtual line VL.

The base material SF, the virtual line VL and the maximum value LPmax for example can be obtained by image-processing the above-described region.

In this way, the plug produced by the above-described method has outer scale layer including pores that extend along the base material surface. The pores allow the outer scale layer to be peeled off more easily with a lower load than the conventional one without applying a high mechanical load or thermal stress.

On the other hand, the inner scale layer in the plug produced by the above-described method has a structure as dense as or denser than that of the conventional inner scale layer even though the oxygen concentration in the heat treatment atmosphere is higher than the conventional case. Therefore, it is equally or less easily peeled off as compared to the conventional inner scale layer during piercing and rolling.

3. Piercing and Rolling

The plug according to the embodiment is removed of the outer scale layer and then used to pierce and roll. More specifically, using the plug removed of the outer scale layer and having the inner scale layer remaining on the surface, a metal material (such as a round billet) is pierced and rolled and produced into a metal pipe. As described above, the outer scale layer can easily be peeled off with a lower load than the conventional one without applying a mechanically high load using a hammer or the like or applying abrupt thermal stress. Therefore, outer scale layer is less likely to remain on the plug surface, and fewer irregularities are formed on the plug surface. Consequently, defects at the inner surface of the seamless pipe attributable to the irregularities on the plug surface can be reduced.

Example 1

A plurality of plug material specimens (hereinafter simply as "specimens") designated mark 1 to mark 6 were prepared. The plug materials had the chemical composition in Table 1. The specimens each had a length of 200 mm, a width of 100 mm, and a thickness of 50 mm.

The specimens were each subjected to scale treatment in the heat treatment conditions in Table 3, and an oxide scale layer is formed on each of the specimen surfaces.

TABLE 3

| mark | Heat treatment temperature (° C.) | holding time (hr) | Oxygen conc. (vol. %) | oxide scale average thickness (μm) | LPmax (μm) | number of dropped balls |
|---|---|---|---|---|---|---|
| 1 | 1050 | 6 | 2.0 | 520 | 400 | 200 |
| 2 | 1000 | 25 | 2.0 | 680 | 900 | 5 |

TABLE 3-continued

| mark | Heat treatment temperature (° C.) | holding time (hr) | Oxygen conc. (vol. %) | oxide scale average thickness (μm) | LPmax (μm) | number of dropped balls |
|---|---|---|---|---|---|---|
| 3 | 1000 | 25 | 0.0 | 620 | 400 | 65 |
| 4 | 1000 | 25 | 1.0 | 650 | 800 | 10 |
| 5 | 1000 | 25 | 5.0 | 700 | 900 | 5 |
| 6 | 1025 | 15 | 0.0 | 600 | 300 | 50 |

During the heat treatment, the temperature rising time from room temperatures to the heat treatment temperatures in Table 3 was 4 hours, and the holding time was adjusted so that the oxide scale layers formed at the specimens each had a thickness from 500 μm to 750 μm. During the heat treatment, the oxygen concentration was measured with an oximeter and the air-fuel ratio in the heat treatment furnace was adjusted so that the average of the oxygen concentration in the heat treatment was the value in Table 3. The components of the heat treatment atmosphere other than oxygen were as follows. The $CO_2$ concentration was set to 10 vol. % and the $H_2O$ concentration was set to 10 vol. %. The balance consists of $N_2$ and impurities.

Structure Observation

After the heat treatment, a sectional sample of the plug surface was taken from an arbitrary position (a single position) of each of the specimens. At each of the obtained sectional samples, a section (section of the oxide scale layer and the plug surface) of an arbitrary region having a width of 1000 μm was observed with an optical microscope, and examined for LPmax by the following method. Each of the sectional samples was image-processed and points at intervals of 10 μm on the base material (plug material) surface within the sectional region were extracted. A straight line (base material surface) SF of a linear function was obtained from these points by a least squares method. Virtual lines VL parallel to the obtained line SF and having a length of 1000 μm were sequentially provided as they were shifted from one another in the thickness-wise direction of the outer scale layer. In the positions, the length of the part of the virtual line VL overlapping the pores was obtained. When the virtual line VL overlapped a plurality of pores, the total length of the overlapping parts was obtained. The maximum value LPmax among the lengths obtained for the virtual lines VL was determined. The LPmax of each of the specimens is given in Table 3.

Peelability Examination

The peelability of the outer scale layer formed on the surface of each of the plug material specimens after the heat treatment was evaluated by a drop ball test.

The drop ball test was carried out by the above-described method (see FIG. 4). The number of dropped balls until the removal was confirmed was counted. When the number of the dropped balls was not more than 10, it was determined that the specimen has good peelability.

Result of Tests

The result of tests in the peelability examination is given in Table 3. The number in the column for the "number of dropped balls" in Table 3 represents the number of dropped balls until the peeling was confirmed. With reference to Table 3, for marks 2, 4, and 5 that each satisfy the heat treatment temperature and the oxygen concentration defined by the invention, the number of dropped balls was not more than 10, in other words, the outer scale layer had good peelability. In each of these plug material specimens, the inner scale layer was not peeled off by the drop ball test.

On the other hand, in the specimen with mark 1, the oxygen concentration was within the range defined by the invention, but the heat treatment temperature exceeded the upper limit by the invention, the outer scale layer was not easily peeled off, and the number of dropped balls was greatly more than 10. In the specimens with marks 3 and 6, the heat treatment temperature was within the range defined by the invention, while the oxygen concentration was less than the lower limit by the invention. Therefore, the outer scale layer was not easily peeled off and the number of dropped balls was more than 10.

Example 2

A plug subjected to scale treatment at a heat treatment temperature of 1025° C. and a plug subjected to scale treatment at a heat treatment temperature of 1000° C. were produced and the wear resistance and the peelability of the inner scale layer of each of the plugs after piercing and rolling were examined.

More specifically, a plurality of plugs of materials shown in Table 1 were prepared. Among the prepared plugs, some of the plugs were subjected to scale treatment at a heat treatment temperature of 1025° C. Hereinafter, these plugs will be referred to as "1025° C. plugs." The rest of the plugs were subjected to scale treatment at a temperature of 1000° C. These plugs will be referred to as "1000° C. plugs." The holding time (soaking time) for the heat treatment temperature was adjusted so that the resulting inner scale layer had a thickness of about 600 μm. The heat treatment atmosphere was that in condition 2 in Table 2.

An inner scale layer as thick as 600 μm was formed at the surfaces of the 1025° C. and 1000° C. plugs after the scale treatment. The outer scale layers were readily peeled off. Note that the thickness of the inner scale layer was measured by the following method. Using an optical microscope or laser microscope, micro photographs (100× to 200×) of sections of the oxide scale layers of the manufactured 1025° C. and 1000° C. plugs were taken. The thickness of the inner scale layer in arbitrary positions in the microphotographs was measured by image-processing. The average of the measured thickness was defined as the thickness of the inner scale layer.

After the outer scale layer was peeled off, two billets were pierced and rolled using each of the plugs (1025° C. and 1000° C. plugs) having inner scale layer on the surfaces. The thickness of the inner scale layer of each of the 1025° C. plugs after the piercing and rolling was 200 μm. More specifically, the thickness of the inner scale layer was reduced by wear from the value before the piercing and rolling (600 μm) to 400 μm. On the other hand, the thickness of the inner scale layer of each of the 1000° C. plugs was 400 μm and the 1000° C. plugs had higher wear resistance. As shown in FIG. 5, the grain size of the inner scale layer of each of the 1000° C. plugs was about 1 μm and smaller than the grain size (about 4 μm) of the inner scale layer of each of the 1025° C. plugs. Therefore, the inner scale layer of each of the 1000° C. plugs had a denser structure and was estimated to have higher wear resistance.

Furthermore, using each of the plugs, a third billet was pierced and rolled, and the plug surfaces after the rolling were visually observed. As a result, in the 1025° C. plugs, a part of the inner scale layer was peeled off and dissolution was generated at the peeled off part. On the other hand, in the 1000° C. plugs, the inner scale layer was not peeled off and no dissolution was generated.

While preferred embodiments of the present invention have been described above, it is to be understood that variations and modification will be apparent to those skilled in the art without departing the scope and spirit of the present invention. The scope of the present invention, therefore, is to be determined solely by the following claims.

The invention claimed is:

1. A method of manufacturing a plug used to pierce and roll a metal material, comprising the steps of:

preparing a plug material; and manufacturing a plug including an oxide scale layer having a thickness of from 500 μm to 1000 μm and having inner scale layer formed on the surface of the plug material and outer scale layer formed on said inner scale layer by thermally treating said prepared plug material in a heat treatment atmosphere that contains at least 1.0 vol. % oxygen at a heat treatment temperature of at least 950° C. and less than 1050° C. from 6 hours to 25 hours and cooling said thermally treated plug material at a cooling rate of from 25° C./hr to 150° C./hr.

2. The method of manufacturing a plug according to claim 1, wherein in said step of manufacturing the plug including the oxide scale layer, said plug is thermally treated in a heat treatment atmosphere that contains at least 2.0 vol. % oxygen.

3. The method of manufacturing a plug according to claim 1, wherein in said step of manufacturing the plug including said oxide scale layer, said plug is thermally treated at a heat treatment temperature from 950° C. to 1000° C.

4. The method of manufacturing a plug according to claim 2, wherein in said step of manufacturing the plug including said oxide scale layer, said plug is thermally treated at a heat treatment temperature from 950° C. to 1000° C.

5. The method of manufacturing a plug according to claim 1, further comprising the step of removing the outer scale layer in said oxide scale layer.

6. A method of manufacturing a metal pipe, comprising the steps of:

preparing a plug material;

manufacturing a plug including an oxide scale layer having a thickness of from 500 μm to 1000 μm and having inner scale layer formed on the surface of the plug material and outer scale layer formed on said inner scale layer by thermally treating said prepared plug material in a heat treatment atmosphere that contains at least 1.0 vol. % oxygen at a heat treatment temperature of at least 950° C. and less than 1050° C. from 6 hours to 25 hours and cooling said thermally treated plug material at a cooling rate of from 25° C./hr to 150° C./hr removing the outer scale layer in said oxide scale layer; and manufacturing a metal pipe by piercing and rolling a metal material using the plug removed of said outer scale layer.

7. A plug used to pierce and roll a metal material, comprising:

a base material; and an oxide scale layer having a thickness of from 500 μm to 1000 μm and formed on the surface of said base material by heat treatment in a heat treatment atmosphere that contains at least 1.0 vol. % oxygen at a heat treatment temperature of at least 950° C. and less than 1050° C. from 6 hours to 25 hours and cooling said thermally treated plug material at a cooling rate of from 25° C./hr to 150° C./hr.

8. The plug according to claim 7, wherein said oxide scale layer is formed by heat treatment in a heat treatment atmosphere that contains at least 2.0 vol. % oxygen.

9. The plug according to claim 8, wherein said oxide scale layer is formed by heat treatment at a heat treatment temperature from 950° C. to 1000° C.

10. A plug used to pierce and roll a metal material, comprising:

a base material;

an inner oxide scale layer formed on the surface of the base material; and an outer oxide scale layer formed on said inner scale layer and including one or more pores that extend along the surface of said base material, wherein in a section of said outer scale layer having a width of 1000 μm, the LPmax defined by the maximum length of a virtual line parallel to the surface of said base material that overlaps the one or more pores in said outer scale layer is at least 500 μm.

* * * * *